US005255989A

United States Patent [19]

Berthold et al.

[11] Patent Number: 5,255,989

[45] Date of Patent: Oct. 26, 1993

[54] PRINTER DEVICE WITH A THERMAL PRINT HEAD

[75] Inventors: Hans-Gerd Berthold; Heinrich-Friedrich Baumann, both of Paderborn, Fed. Rep. of Germany

[73] Assignee: Data Techno GmbH, Salzkotten, Fed. Rep. of Germany

[21] Appl. No.: 715,097

[22] Filed: Jun. 12, 1991

[30] Foreign Application Priority Data

Aug. 31, 1990 [DE] Fed. Rep. of Germany ..... 4027521

[51] Int. Cl.[5] ..... B41J 11/50

[52] U.S. Cl. ..... 400/605; 400/607.2; 400/617; 400/642

[58] Field of Search ..... 400/584, 585, 585.1, 400/586-588, 591-593, 600.2, 120 HE, 595, 599, 605, 607, 607.2, 610, 621, 621.1, 621.2, 619, 636, 642, 643, 617

[56] References Cited

U.S. PATENT DOCUMENTS 4,229,113 10/1980 Anderson et al. ..... 400/607
4,563,690 1/1986 Tomita et al. ..... 400/608.2
4,569,610 2/1986 Drejza et al. ..... 400/599
4,589,784 5/1986 Valle et al. ..... 400/584
4,701,063 10/1987 Wysk et al. ..... 400/621
4,826,336 5/1989 Kamimura et al. ..... 400/607
5,066,153 11/1991 Stephens ..... 400/621
5,100,251 3/1992 Yasuoka ..... 400/605

FOREIGN PATENT DOCUMENTS 2171082 8/1986 United Kingdom ..... 400/617

*Primary Examiner*—Edgar S. Burr
*Assistant Examiner*—Ren Yan
*Attorney, Agent, or Firm*—Browdy and Neimark

[57] ABSTRACT

Printer device with a thermal print head (70), the print line (71) of which is resiliently pressed against a transport roller (45), which, driven by a motor, transports material to be imprinted (50, 51). Profiled guides (42, 46) form a first feed track for the paper-like material to be imprinted (50) and a second feed track suitable for inserting cardboard-like material (51) to be imprinted. It is possible to use two transport rollers (45A, 45B) with individual drives side-by-side. A tear-off edge (36B) or a motor driven roller cutting assembly is disposed behind the print line (71).

7 Claims, 2 Drawing Sheets

PRINTER DEVICE WITH A THERMAL PRINT HEAD

BACKGROUND OF THE INVENTION

1. Field of the Invention

The invention relates to a printer device with a chassis with lateral assembly plates, between which a spring-loaded, pivotable thermal print head, a transport roller for the material to be printed and the guide means therefore are disposed, which form two feed tracks, the first of which wraps around the transport roller in an approximately semicircular manner and the second wraps around the transport roller over approximately a quarter of a circle.

2. The Prior Art

A printer device of this type is known from German Patent Publication DE No. 35 09 738 A1. It has a print heat with electronically controlled print elements, which can be briefly heated and are arranged in lines which are pressed against a thermo-sensitive ink carrier, for example so-called thermal paper, which is moved vertically to the direction of the lines through the printer device. Depending on its stiffness, the thermal paper is pushed by an electronically controlled, driven transport roller, which can simultaneously be used as a printing counter support, on one of the two feed tracks by the downstream print head with the line of print elements and is subsequently guided to a discharge slot. A plurality of stationary guide elements is provided at the feed side of the transport roller, which are produced and assembled in an expensive manner from many single section elements.

Furthermore, a printer is known from German Utility Patent Publication DE-GM No. 88 03 496, which has paper guide elements with ribs extending in the direction of paper feeding and with supports, which have been produced by means of injection molding technology. However, production by means of injection molding technology is suitable, depending on the injection mold, only for guide elements for a defined printer width and requires an expensive injection mold. This printing device has two reversible supply devices for material to be printed, where in one of them a quasi endless roll is fed to the transport roller by means of an additionally driven transport device, from the back of which it runs off, and where after reversal the second feed track for individual sheets leads through the appropriately reversed paper guide elements behind the print line for further feeding to a driven draw-off device above the printer.

Furthermore, a printing device is known from European Patent Publication No. EP-A-0 288 089, where a paper feed track extends via a pair of feed rollers and a pair of draw-off rollers through a printing gap between a print head and a printing roller, the latter being touched only in the form of lines. A tear-off gap is disposed behind the pair of draw-off rollers. To make possible printing close to the upper torn-off edge, an already fed through printed roll is fed back in after being cut, so that the first printed line at the top is positioned at the print head, where, depending on the position of the first line, the top paper edge is placed in front of the pair of draw-off rollers it has left and the paper only must be grasped by the latter again after printing of a lower line, where it is possible that bunching of the printed roll and therefore inexact line printing may occur.

SUMMARY OF THE INVENTION

It is the object of the invention to simplify a printer device of the above mentioned type substantially and to embody it in such a way that forward and backward transport by the print head of the material to be printed is made possible, so that individual printed pieces with narrow edge areas can be produced.

The design is based advantageously on the rational use of a few basic elements which can be manufactured by machine tools on an assembly line, and which are variously combined in accordance with the different intended uses. The specially designed guides for the printed material can be produced as extruded sections, so that they can be cut to the proper length, depending on the width and number of the thermal lines to be used, which are commercially available in lengths of 2, 3 and 4 inches.

A roller knife is provided for cutting the paper rolls or for cutting off portions of inserted cards or cards in strips.

The two selectively usable record guide tracks provide a wrapping angle of approximately 180° around the transport and counter-pressure roller, which is suitable for thin, thermo-sensitive paper which is preferably pulled off a roll and, in the case of a journal print, is rolled up again on a further roller. They also provide a slightly curved track for the record cards, which provides a contact of the record cards with the transport roller over approximately 90°, so that relatively stiff record cards can be pushed through without trouble and can be driven and moved on by the transport roller. To ease the insertion of record cards, the thermal print head is supported so that it can be pivoted away from the counter-pressure roller. Pairs of guide plates are disposed at the record card output, which extend close to the counter-pressure roller and receive the record cards in a funnel-like manner.

The almost covered guide tracks for the record cards with the funnel-shaped track connections make it advantageously possible to transport the strips of record cards, the front end of which will be cut off and has been imprinted with a label or coupon, in a controlled manner far enough past the cutting or tear-off edge, so that they can be cut-off directly behind the imprint, after which the record card roll can be operated in the opposite direction. In this case the end of the roll is suitably, if this is a requirement, pulled back close to the print line, after which it is possible to start the imprinting of another label or coupon. Thus it is possible to produce imprinted sections which have only narrow edges in the direction of transport, so that a correspondingly efficient use of the thermo-sensitive material is possible.

BRIEF DESCRIPTION OF THE DRAWINGS

Further characteristics, advantages and details of the invention ensue from the following description of the preferred embodiments by means of the drawings, in which.

DETAILED DESCRIPTION OF THE PREFERRED EMBODIMENTS

Figure 1:
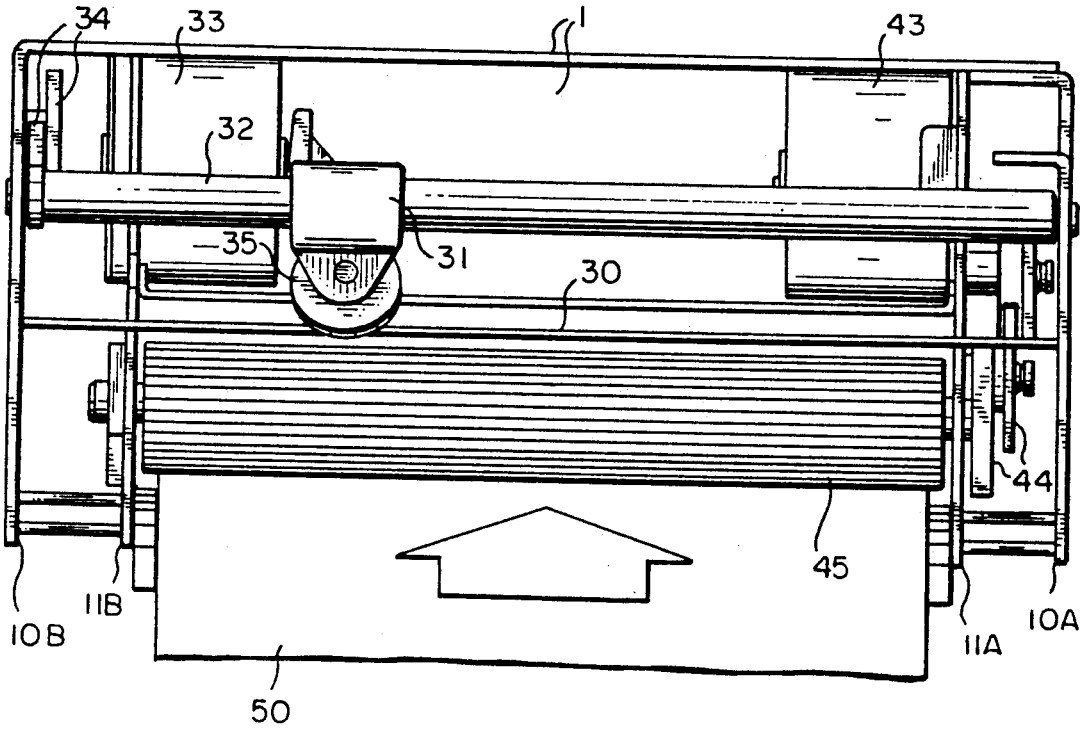
FIG. 1 is a top view of a printer device with a receipt transport device and a cutting assembly.

FIG. 1 illustrates a chassis (1) with side walls (10A, 10B), between which a cutting assembly (30, 31, 32) is maintained, and parallel to which assembly plates (11A, 11B) with spacers have been laterally installed. A drive motor (33, 43) is mounted on the inside of each one of these plates (11A, 11B), the shafts of each of which extend in the adjacent space between the plates (11A, 11B) and the side walls (10A, 10B). A cutting assembly drive (34) is disposed in one of these spaces and is coupled to the drive shaft of the spindle (32) of the knife carriage (31). A feed gear (44) is disposed in the other space, which on its driven side is connected with the transport roller (45) of the paper transport device, which is shown in the form of an incoming roll of paper. A circular cutting knife (35) is rotatably seated on the knife carriage (31), which extends with a portion of the knife beyond a horizontal cutter bar (30), so that its cutting edge shearingly cooperates with the knife edge when the knife carriage (31) is moved in the direction of the spindle by the drive motor (33).

Figure 2:
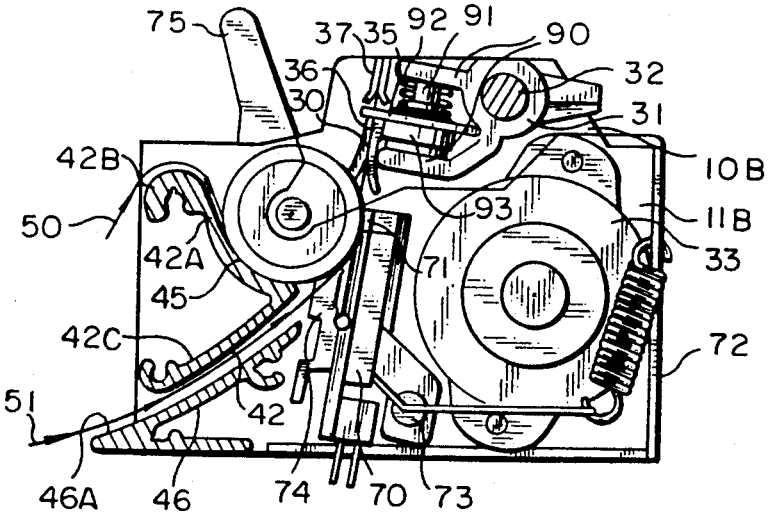
FIG. 2 is a cross section of a printer device with cutting assembly.

FIG. 2 which is a vertical section through FIG. 1, shows the knife carriage (31), which is seated with a threaded bushing on the spindle (32) so it can be drivingly displaced, has a yoke-shaped support (90), between which extends the axle (91) of the roller knife (35). A pressure spring (92) is disposed above the latter, which presses the roller knife (35) against the cutter bar (30). A cylindrical roller (93) is seated on the axle (91) below the roller knife and is connected therewith, the jacket of which is supported by contact with a guide plate (36) and rolls during a cutting operation and drives the roller knife (35) in this way. Furthermore, the roller (93) and the roller knife (35) provide the counter support on the guide plate (36) and the cutter bar (30) against the moment of friction of the knife carriage (31) on the drive spindle (32) during the drive.

FIG. 2 further shows the side plate (11B), on which the cutting assembly drive motor (33) is fastened, is mounted at a distance from the side wall (10B). The transport roller (45) is seated on the side plate (11B) and two extruded, profiled guide strips (42, 46) are fixed there which extend as far as the opposite side plate (11A), the same as the transport roller. The first profiled guide strip (42) encloses with its central portion (42A) the lower front circumferential section of the transport roller (45), leaving a small gap for the paper to pass through. An inlet area (42B), semi-circular and convex towards the outside at the top and forming an inlet funnel for a paper roll (50) together with the transport roller (45), follows above the central portion (42A). Following the bottom of the central portion (42A) is a slightly convexly curved record card roll area (42C), obliquely angled towards the front. In relation to this and fixed at a distance which constitutes an inlet gap, a second profiled guide strip (46), assigned to the latter and shaped complementary, i.e. concave, in the record card inlet area, is fastened. This second profiled strip (46) extends towards the front around a record card inlet surface (46A) over the other profiled strip (42), so that a record card (51) can be easily placed with its edge in this area and then inserted into the inlet gap.

The material to be printed, a record card (51), which preferably consists of stiff paper, a label support or cardboard is inserted through the inlet gap approximately tangentially on the jacket of the transport roller (45), around which it wraps for approximately 45° and from which it is guided on the outlet side past the cutter bar (30) which, together with the guide plate (36), forms a record card guide funnel leading in the direction of the cutting edge. On the outlet side of the cutter bar (30) a further, short section guide funnel (37) is disposed around sheet metal elements placed at a distance equalling the thickness of the cardboard.

Pre-stressed by a spring (72), the printing bar (70) with its print line (71) lies against the area of the transport roller (45) wrapped by the record card (51) or the paper (50). With its pivot shaft (73), the printing head (70) is seated in the plates 11A, (11B) and connected with a manual lever (75), which permits the lifting of the print line (71) from the transport roller (45) against the force of the spring when a record card is inserted. In the inlet area of the record card (51) and in front of the print line (71), a guide piece (74) is fastened on the printing head (70), so that the record card (51) has satisfactory contact for being guided in the wrap area of the transport roller (45). The various, application-specific embodiments of the printer device with only one transport roller (45) are provided in a practical way in widths up to the customary 80-digit line width.

Figure 3:
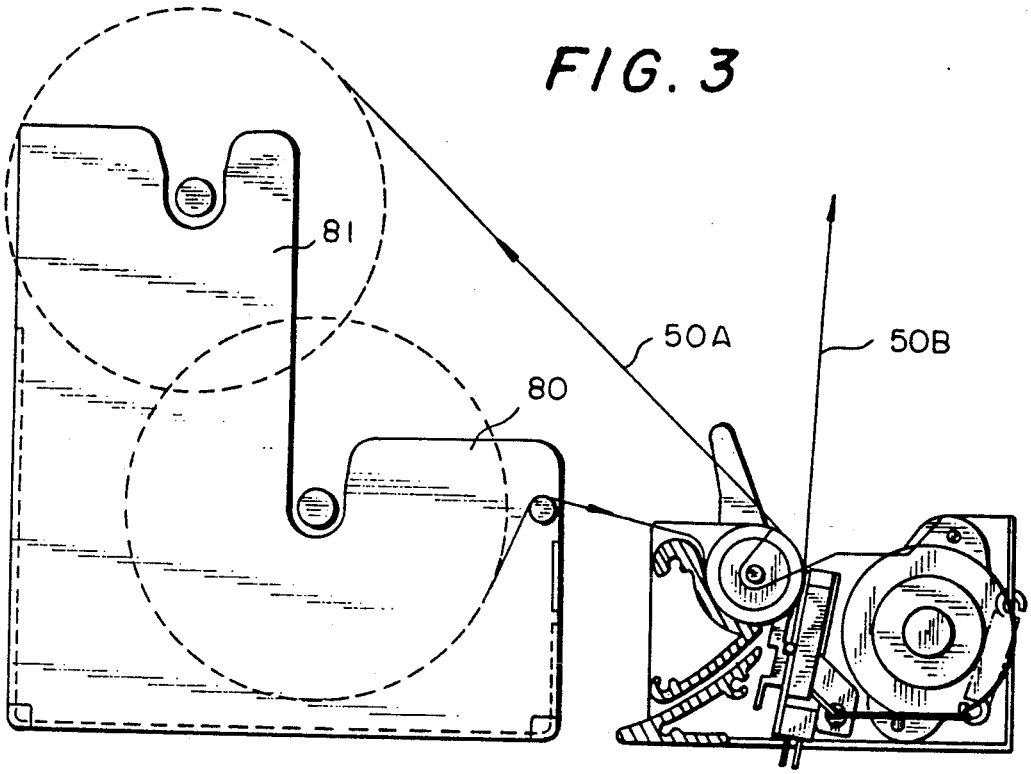
FIG. 3 is a cross section of a printer device with two paper rolls and journal winding device.
Figure 4:
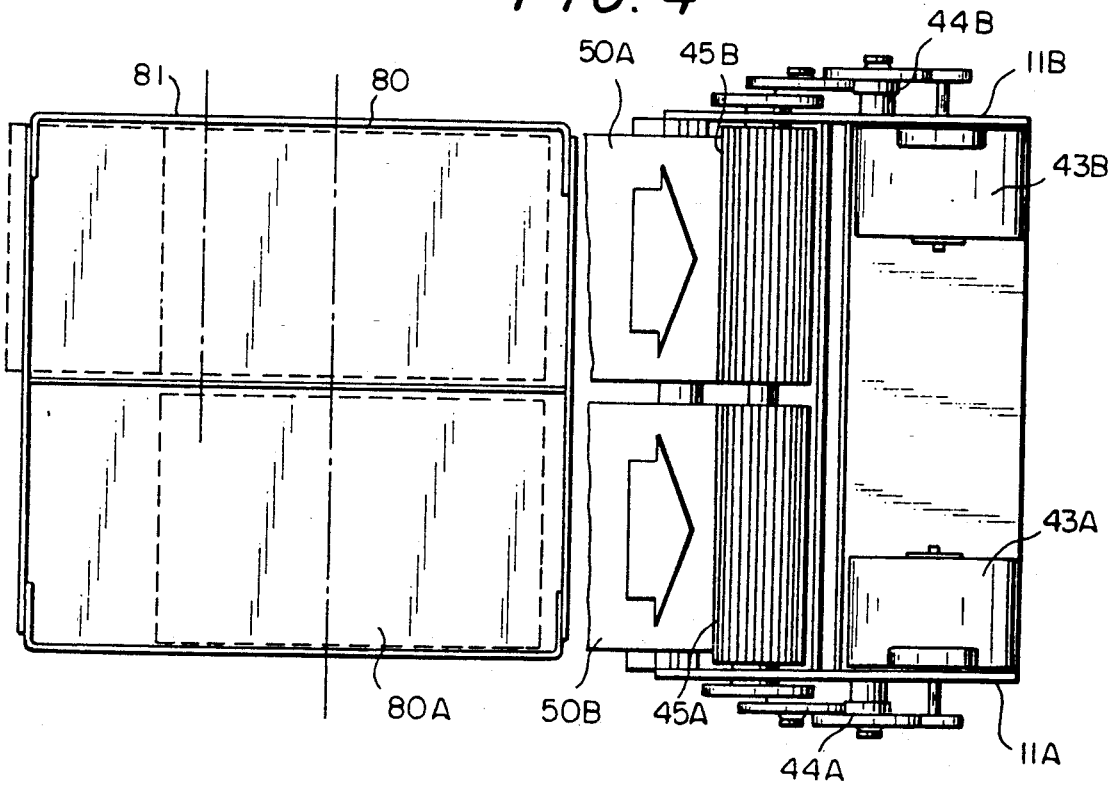
FIG. 4 is a top view of FIG. 3.

FIG. 3 shows a vertical sectional view and FIG. 4 a top view of an embodiment with two transport areas located side-by-side, which are particularly suited for use in connection with cash registers, because one of the paper rolls (50A) is fed, while partially wrapping around the transport roller, from a supply roller (80) to a take-up roller (81), which in a known manner is driven with limited pull. In the use with cash registers, the supply and take-up rollers (80, 81) are suitably placed into a lockable housing, as indicated in FIG. 4. The supply roller (80A) for the second paper roll (50B) is also placed into the latter, which is fed to a tear-off or cutting device for issuing a receipt at the outlet side of the print line, which has been removed and is not shown. The two paper rolls (50A, 50B) are each guided over a transport roller (45A, 45B), each of which is separately driven by a motor (43A, 43B) with associated gear (44A, 44B). The transport gears (44A, 44B) are mounted on the plates (11A, 11B), so that it is possible to do without the side walls in case no cutting assembly is employed.

What is claimed is:

1. A printer device comprising:

a chassis (1) with lateral assembly plates (11A, 11B);

a spring-loaded, pivotable thermal print head (70), a transport roller (45) for the material (50, 51) to be printed and guide means for said material to be printed disposed between said lateral assembly plates (11A, 11B);

said transport roller (45) forming a counter-pressure support which supports said material (50, 51) to be printed against said spring-loaded pivotable thermal print head (70); a drive motor and a feed gear driven by said drive motor;

feed means consisting of only said transport roller (45) connected to said drive motor (33) through said feed gear (44) for generating a forward movement of said material to be printed;

said guide means located at an inlet side of said device consisting of a first profiled strip (42A, 42B, 42C) and a second profiled strip (46) each having a cross section in a plane perpendicular to the long axis of said transport roller (45);

said first profiled strip (42A, 42B, 42C) having a first leg (42A, 42B) and a second leg (42C);

said first leg forming a first feed track, comprising a first portion (42A) which wraps approximately 90° around said transport roller (45) at a distance and a second portion (42B) which has a convexly rounded surface (42*b*) producing a first inlet for said first feed track at said inlet side of said device;

said second portion creating a funnel which narrows in relation to said transport roller (45) as it approaches said first portion;

said second leg (42C) of said first profiled strip being acutely angled away to form the downstream end of said first portion (42A);

said second leg being convexly rounded as it approaches said inlet side of said device;

said second profiled strip (46) having a third leg connected to a base in the same plane as a bottom of said device;

said third leg being located at a distance and substantially parallel to said second leg (42C) to form a second feed track therewith;

said second feed track having a second inlet having a funnel-shaped opening into said second feed track;

said second feed track having a direction substantially tangential to a circumference of said transport roller (45); and said first inlet and said second inlet being at different angles to each other with respect to said transport roller (45).

2. A printer device in accordance with claim 1, wherein said first profiled strip and said second profiled strip are extruded parts.

3. A printer device in accordance with claim 2, wherein said print head (70) is mounted on a support plate spring-loaded means engaged to said support plate for pivoting said print head in respect to said transport roller (45) on which is disposed on said inlet side a guide element (74) ahead of a print line (71).

4. A printer device in accordance with claim 2, wherein a supply roller device (80, 80A) is seated ahead of said first inlet of said first feed track, and at least one take-up roller device (81) is placed behind an outlet side of said first feed track.

5. A printer device in accordance with claim 1, wherein said print head (70) is mounted on a support plate, spring-loaded means engaged to said support plate for pivoting said print head in respect to said transport roller (45) on which is disposed on said inlet side a guide element (74) ahead of a print line (71).

6. A printer device in accordance with claim 5, wherein a supply roller device (80, 80A) is seated ahead of said first inlet of said first feed track, and at least one take-up roller device (81) is placed behind an outlet side of said first feed track.

7. A printer device in accordance with claim 1, wherein a supply roller device (80, 80A) is seated ahead of said first inlet of said first feed track, and at least one take-up roller device (81) is placed behind an outlet side of said first feed track.

* * * * *